US006273826B1

(12) United States Patent
Bauer

(10) Patent No.: US 6,273,826 B1
(45) Date of Patent: Aug. 14, 2001

(54) GOLF SWING TRAINING APPARATUS

(76) Inventor: Robert Bauer, 2110 E. 54th St. South, Wichita, KS (US) 67216

( * ) Notice: Subject to any disclaimer, the term of this patent is extended or adjusted under 35 U.S.C. 154(b) by 0 days.

(21) Appl. No.: 09/270,571

(22) Filed: Mar. 16, 1999

(51) Int. Cl.[7] ..... A63B 57/00; A63B 69/36
(52) U.S. Cl. ..... 473/219; 473/259
(58) Field of Search ..... 473/219, 216, 473/221, 259, 257, 264; D21/791

(56) References Cited

U.S. PATENT DOCUMENTS

D. 336,121 * 6/1993 Bellagamba .
D. 336,673 * 6/1993 Ohly et al. .
1,633,527 * 6/1927 Hansen .
1,670,409 * 5/1928 Hansen .
1,960,787 * 5/1934 MacStocker .
2,807,472 * 6/1957 Hatfield .
3,341,208 * 9/1967 Marcella .
3,583,707 * 6/1971 Fujimoto .
4,852,881 * 8/1989 Bellagamba et al. .
4,919,432 * 4/1990 Coggins et al. .
4,928,974 * 5/1990 VanKirk .
5,026,065 * 6/1991 Bellagamba .
5,330,192 * 7/1994 Amos .
5,441,275 * 8/1995 Yoshishita .
5,595,545 * 1/1997 O'Brien .
5,984,798 * 11/1999 Gilmour .

* cited by examiner

*Primary Examiner*—Jeanette Chapman
*Assistant Examiner*—M. Chambers
(74) *Attorney, Agent, or Firm*—Kenneth H. Jack; Davis & Jack, L.L.C.

(57) ABSTRACT

A golf swing training apparatus consisting of a base; a club guide ring; left, right, and rear hinge shafts; left, right, and rear hinge sleeves, the left, right, and rear hinge shafts extending through the left, right, and rear hinge sleeves so that the left and right ends of the left, right, and rear hinge shafts extend leftwardly and rightwardly from the left and right ends of the left, right, and rear hinge sleeves. Each of the left and right ends of the left, right, and rear hinge shafts are attached to the base or making up a part of the base. Left, right, and rear slip joints are provided for attaching the club guide ring to the left, right, and rear hinge sleeves. The rear slip joint consists of an alternately extendable and retractable shaft for, upon alternate extension and retraction, alternately pivoting and counter-pivoting the club guide ring about the left and right hinge shafts.

14 Claims, 9 Drawing Sheets

GOLF SWING TRAINING APPARATUS

FIELD OF THE INVENTION

This invention relates to apparatus for training a golfer's swing. More particularly, this invention relates to such apparatus including or incorporating a club guide ring.

BACKGROUND OF THE INVENTION

Where a golf club swing is correct or "true", the direction of the instantaneous velocity (i.e., tangential velocity) of the head of the golf club at its point of impact with a golf ball coincides with the golfer's aim line. Upon making a true swing, the golf ball caroms off of the face of the club at an angle matching the loft angle of the club. Upon impact of such club face upon the golf ball, rotation about a horizontal axis, or back spin, is imposed upon the golf ball. Because golf balls typically are dimpled, such back spin beneficially provides lift and extra flight distance without curving the ball's flight leftward or rightward from the aim line.

In order for the direction of the instantaneous velocity to be consistent with a golfer's aim line, both the aim line and the arced path of the club head prior to meeting the golf ball must lie within a single plane. Where the aim line intersects such plane, the direction of the instantaneous velocity of the club head at the point of impact with the golf ball will deviate either rightward or leftward of the aim line. Such deviation of the instantaneous velocity tends to push or pull the ball away from the aim line, and tends to tilt the axis of rotation of the golf ball, causing the ball to curve rightward or leftward. Such out of plane golf swings are known as "hook" swings or "slice" swings, as opposed to a true swing. Assuming a right-handed swing, hook swings tilt the axis of rotation of the golf ball counter-clockwise resulting in leftward flight deviation, and slice swings tilt the axis of rotation clockwise, resulting in rightward flight deviation. "Grooving" a golfer's swing so that the arced path of the club head lies in a plane which contains, rather than intersects, the aim line is a key challenge of the game. Several types of golf swing training apparatus are known; such apparatus actually or ostensibly serving the function of promoting "muscle memory" which urges a golfer's shoulders, arms, hands and club to swing in unison within a correct plane. One such type of known golf swing training apparatus is a ring trainer, which includes a large ring for guiding the shaft of a golf club as a golfer swings the club through an arc to meet the golf ball or golf tee. Such ring trainers are exemplified by apparatus disclosed in U.S. Pat. No. 5,467,993 issued Nov. 21, 1995 to Higginson; U.S. Pat. No. 5,595,545 issued Jan. 21, 1997 to O'Brien; U.S. Pat. No. 5,816,932 issued Oct. 6, 1998 to Alexander; U.S. Pat. No. 5,423,548 issued Jun. 13, 1995 to Bricker; U.S. Pat. No. 5,441,275 issued Aug. 15, 1995 to Woshishita; U.S. Pat. No. 5,429,367 issued Jul. 4, 1995 to Amos; and U.S. Pat. No. 4,949,974 issued Aug. 21, 1990 to Bellagamba. Such known golf swing trainers incorporating a club guide ring are mechanically complex, are uneconomically fabricated, are difficult to assemble and disassemble, and cannot be efficiently configured for storage or passage through doorways.

The instant invention solves the above problems by providing a golf swing training apparatus including club guiding ring; such apparatus being mechanically simple, being economically fabricated, being easily assembled and disassembled, and such apparatus being easily configured for storage or for passage through doorways.

BRIEF SUMMARY OF THE INVENTION

All of the major structural elements of the present inventive golf swing training apparatus preferably comprise furniture grade polyvinyl chloride plastic tubing. Suitably, other materials, such as aluminum tubing, may be utilized.

A major structural element of the instant inventive golf swing training apparatus comprises a ring between 50–70 inches in diameter. The ring preferably is supported by a base, the base having a forward section and a rearward section. Preferably, the rearward section of the base is pivotally attached to the forward section of the base.

The forward and lower end of the ring preferably is pivotally attached to the base by means of a pair or inverted "U" shaped tubes which dually serve as base support brackets and hinge shafts. Preferably, the lower ends of such brackets are fixedly attached to the base while the upper arcuately curved ends of such shafts support a pair of T-joint hinge sleeves, which in turn support the lower and forward end of the ring. While such hinge shafts may be suitably linearly configured and horizontally oriented, an arcuately curved configuration of such shafts is preferred, the curvatures serving the function of centering and preventing lateral sliding of the T-joint hinge sleeves.

The rearward and upper end of the ring is preferably supported by an extendable and retractable telescoping shaft. The lower end of the telescoping shaft preferably is pivotally attached to the rearward end of the rearward section of the base by means of a T-joint hinge sleeve. Preferably, the rearward section of the base also has a "U" configuration allowing such section to serve dual functions of centering the hinge sleeve of the telescoping shaft and providing base support. Like the pair of inverted "U" shaped tubes, other configurations of the rearward section of the base may be suitably utilized.

All of the jointed attachments of the ring to the base and to the telescoping shaft preferably comprise slip joints removably attached by means of shear pins extending through shear pin receiving apertures.

The polyvinyl chloride plastic tubing structure as described above allows for convenient adjustment of the angle of the ring with respect to the ground through alternate and selective extension and retraction of the telescoping shaft. Said structure may be easily and conveniently assembled or disassembled through manipulation of shear pins extending through the slip joint attachments. For convenience in storage of the apparatus or for transport of the apparatus through a doorway, the rearward section of the base may move pivotally upward, narrowing the side profile of the apparatus.

Accordingly, it is an object of the present invention to provide a golf swing training apparatus providing a golf club guiding ring, the lower forward portion of the ring being supported by a pair of "U" shaped brackets.

It is a further or alternate object of the present invention to provide such an apparatus having a base including a forward section and a rearward section, the rearward section of the base being pivotally attached to the forward section of the base, allowing pivotal motion of the base, narrowing the side profile of the apparatus, and allowing convenient storage or maneuvering of the apparatus.

Modes of use, and other and further objects, benefits, and advantages of the present invention will become known to those skilled in the art upon review of the Detailed Description which follows and upon review of the appended drawings.

DETAILED DESCRIPTION OF THE PREFERRED EMBODIMENT

Figure 1:
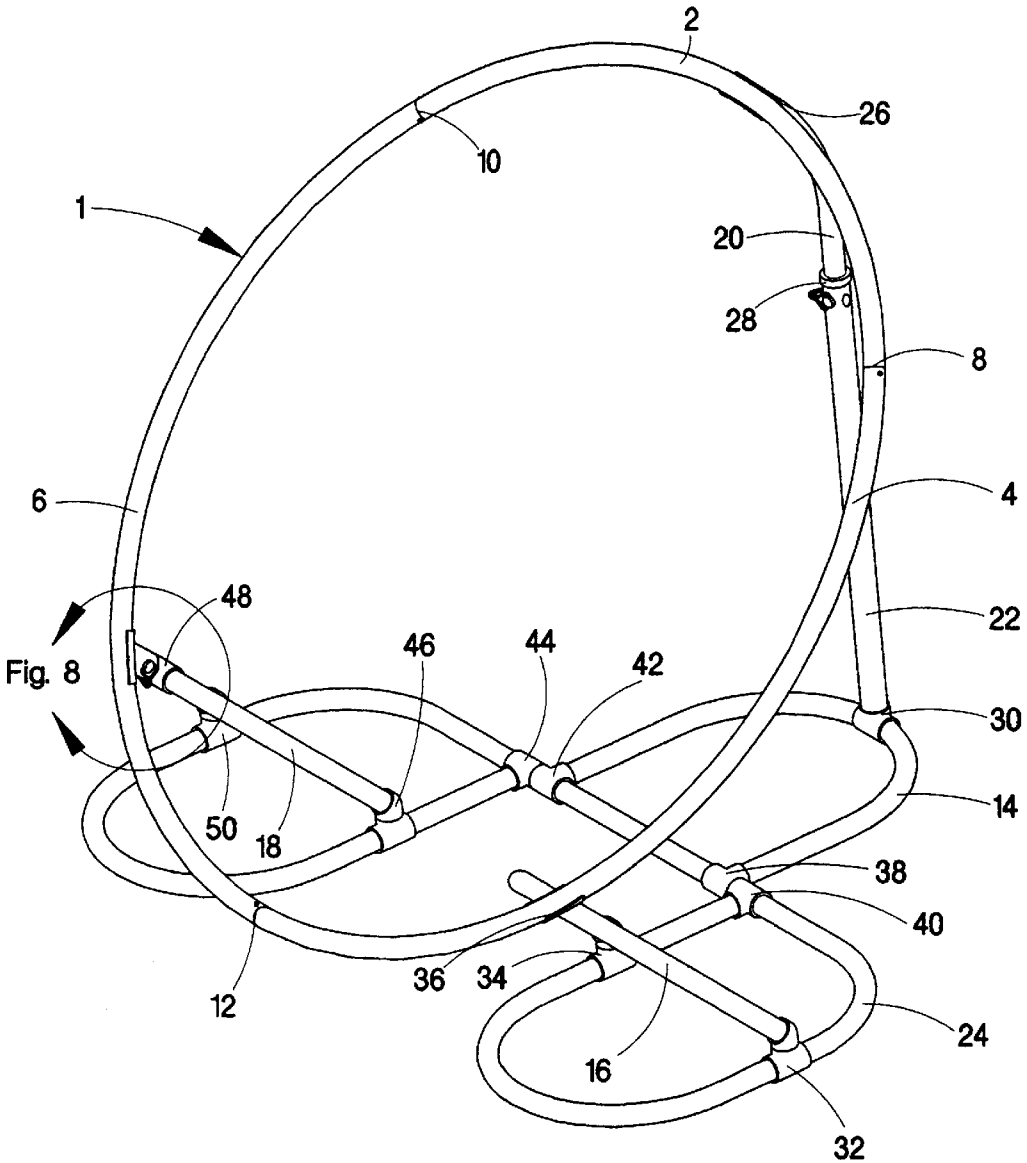
FIG. 1 is an isometric view of the present inventive golf swing training apparatus.

Referring now to the drawings, and in particular to Drawing FIG. 1, the tubular ring of the present inventive golf swing training apparatus is referred to generally by Reference Numeral 1. Preferably, all major structural components of the golf swing training apparatus are composed of furniture grade polyvinyl chloride plastic tubing. Suitably, other materials such as aluminum tubing may be utilized.

Referring further to FIG. 1, the base of the golf swing training apparatus preferably comprises a forward section 24, and a rearward section 14; the rearward section 14 being pivotally attached to the forward section 24 by means of a pair of 90 degree T-joints 38 and 42, such T-joints serving as hinge sleeves. Preferably, the forward section 24 of the base comprises four 45 degree T-joints 32, 34, 46, and 50, and two 90 degree T-joints 40 and 44, each of such T-joints interlinking straight and arcuately curved sections of polyvinyl chloride plastic pipe as depicted.

The rearward section of the base preferably comprises a "U" shaped rearward tube 14, such rearward tube 14 serving the dual functions of base support, and providing a hinge shaft extending through T-joint hinge sleeve 30. While the rearward tube 14 may suitably be configured rectangularly, a "U" shaped configuration is preferable as such configuration prevents lateral sliding of the T-joint hinge sleeve 30. Preferably, the left and right ends of the rearward tube 14 are fixedly mounted within T-joints 38 and 40 which themselves preferably act as hinge sleeves pivotally attaching the rearward tube 14 to the forward tube 24.

Preferably, the lower end of the ring is supported by a left tube 16 and a right tube 18, such tubes serving the dual functions of providing base support for the ring 1 and providing hinge shafts extending through T-joints hinge sleeves 36 and 48. While the left and right tubes 16 and 18 may suitably be rectangularly configured, it is preferable that such tubes be arcuately configured as depicted, the arcuate configurations serving the function of preventing lateral sliding of T-joint hinge sleeves 36 and 48. Preferably, the left and right ends of the left tube 16 and of the right tube 18 are fixedly mounted within fixed 45 degree T-joints 32, 34, 46, and 50.

Referring further to FIG. 1, the ring 1 preferably comprises tubes 2, 4, and 6, each being arcuately curved through 120 degrees, such tubes 2, 4, and 6 being interconnected by slip joints 8, 10 and 12, each such slip joint preferably having a threaded bolt extending therethrough, the threaded bolts being retained by threaded nuts. Preferably, the bolts extending through slip joints 8, 10, and 12 are oriented so that they do not protrude from the forwardly facing surface of the ring.

Figure 8:
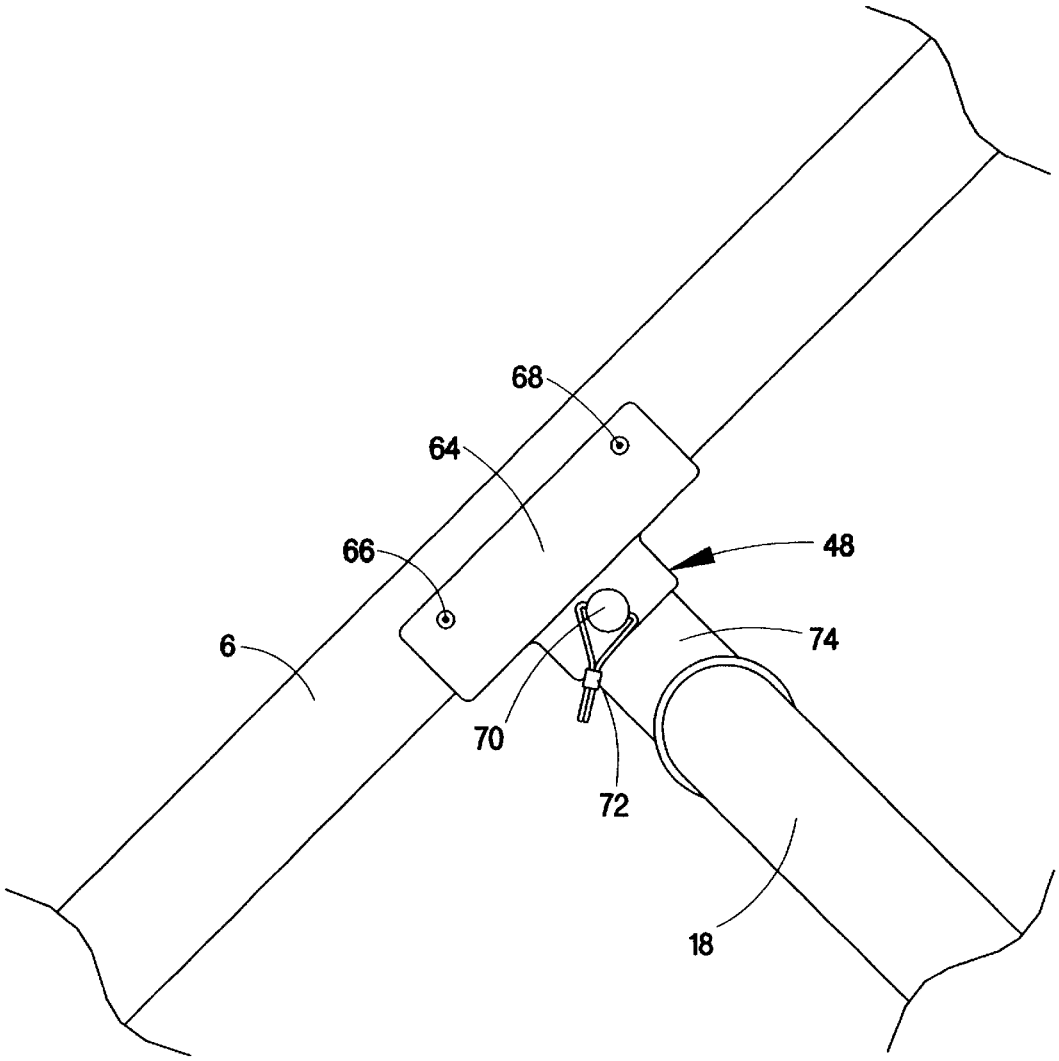
FIG. 8 is a magnified partial view as indicated in FIG. 1.
Figure 9:
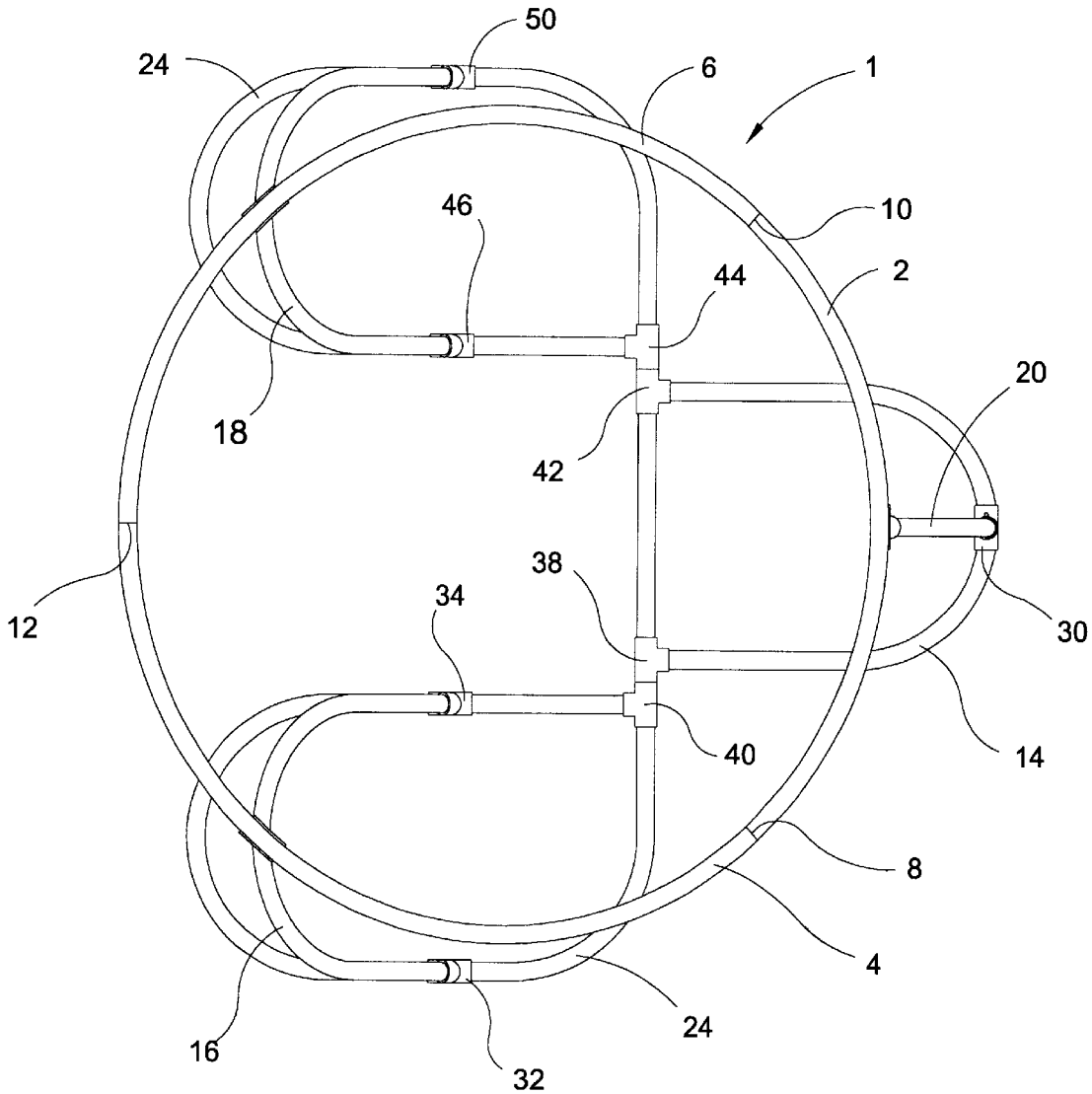
"FIG. 9 is a top plan view of the structure depicted in FIG. 1."

Referring simultaneously to FIGS. 1 and 8, tube 6 is pivotally attached to right tube 18 by T-joint 48, the T-joint 48 preferably comprising a fixed half sleeve 64 and a full sleeve 74 which together form a nesting slip joint. Preferably, the half sleeve 64 is attached to tube 6 by means of rivets 66 and 68. Also preferably, the slip joint has a pin receiving aperture therethrough, such aperture having a shear pin 70 extending therethrough, such shear pin 70 being securely retained by a clip 72. Joint 36 is preferably configured similarly with joint 48.

Referring further to FIG. 1, the upper end of the ring is preferably supported upon the rearward tube 14 by telescoping nesting tubes 22 and 24 which form an extendable and retractable shaft. The upper end of tube 20 is preferably fixedly attached to tube 2 by means of a half sleeved T-joint 26. Suitably, joint 26 may be alternately configured as a pivoting joint where the overall structure of the apparatus lacks sufficient flexibility to avoid damage of joint 26. Preferably, the lower end of tube 22 is pivotally mounted to rearward tube 14 by T-joint hinge sleeve 30.

Figure 3:
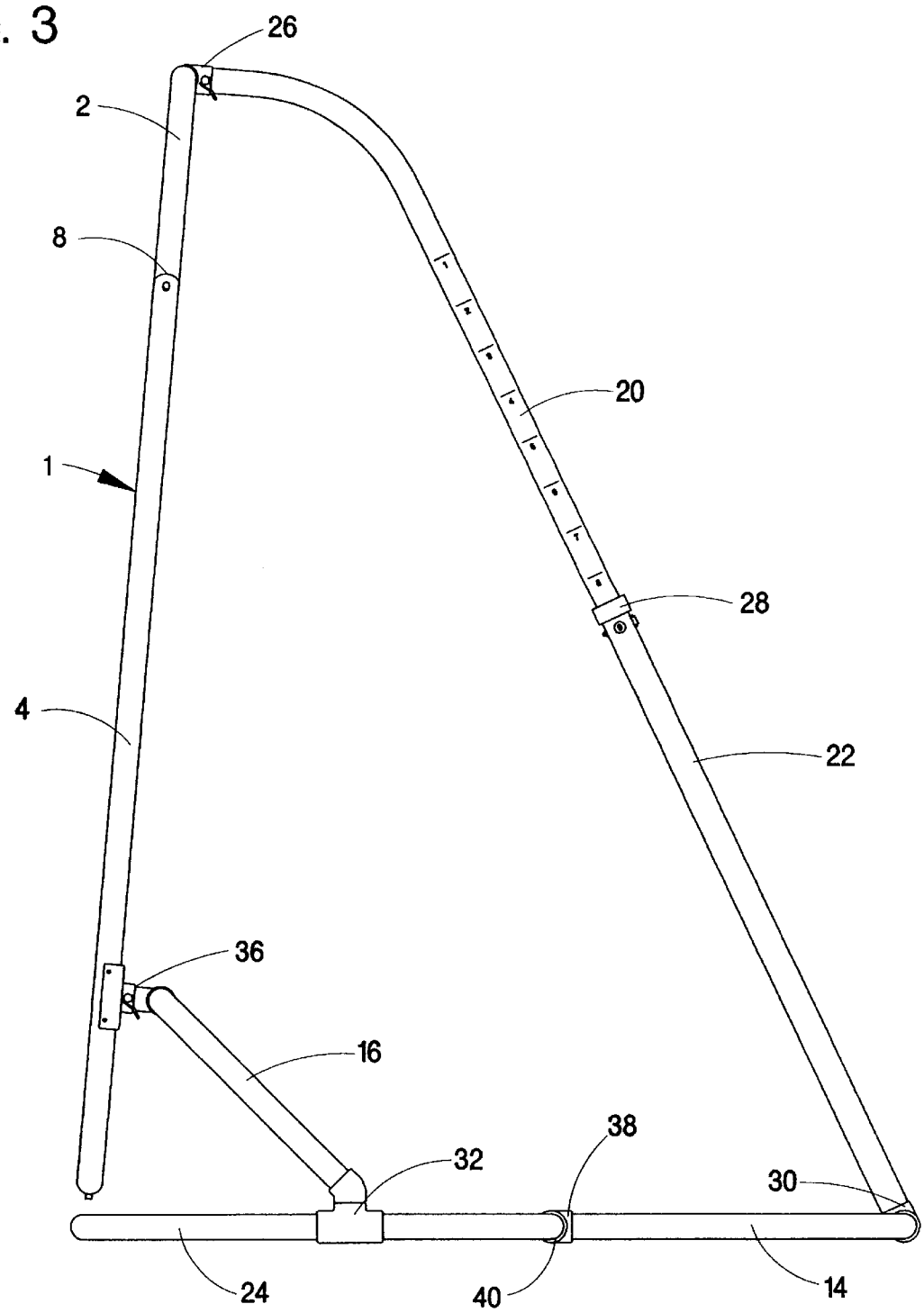
FIG. 3 is a side view of the apparatus depicted in FIG. 1, the view showing its telescoping shaft upwardly extended.
Figure 6:
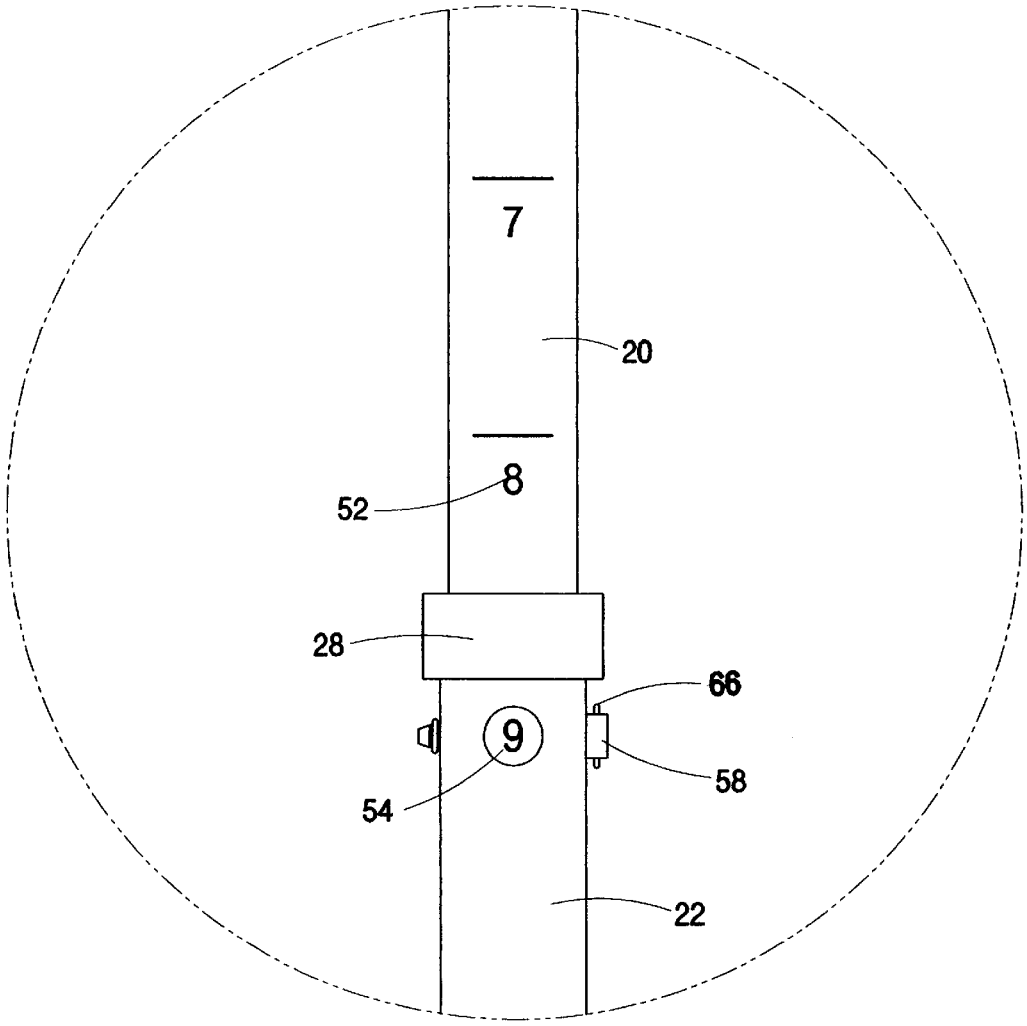
FIG. 6 is a magnified partial view as indicated in FIG. 3.
Figure 7:
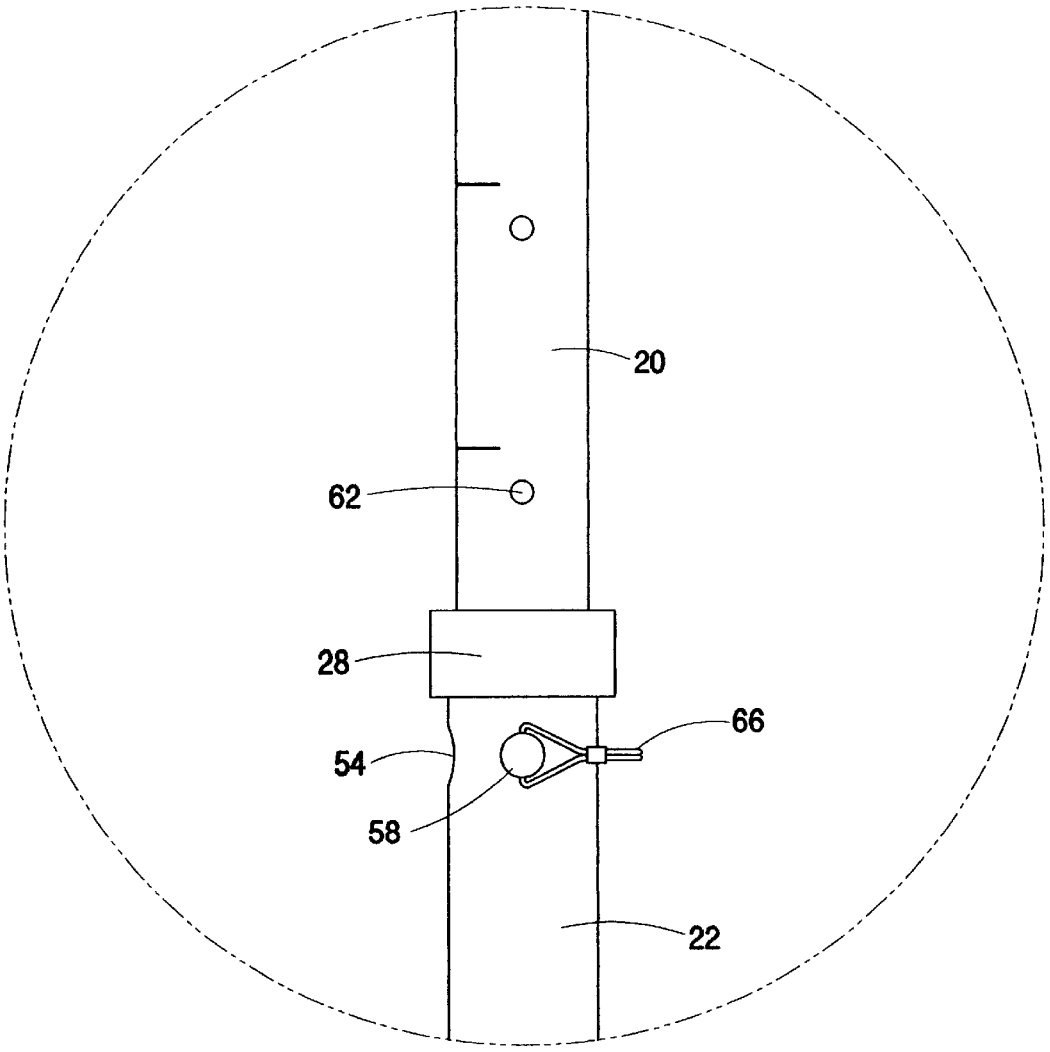
FIG. 7 is an alternate view of the structure depicted in FIG. 6.

Referring simultaneously to FIGS. 3, 6, and 7, tube 20 is shown at its maximum extension from tube 22. Preferably, tube 20 has a plurality of calibrating lines and numbers 52 printed thereon. Also preferably, tube 20 has a plurality of shear pin apertures 62 extending therethrough, the shear pin apertures 62 corresponding with the calibration lines and numbers 52. Preferably, the upper end of tube 22 has a reinforcing collar 28, such collar preventing the upper end of tube 22 from splitting. Tube 22 has a shear pin aperture therethrough through which shear pin 58 may extend, fixing tube 20 at a desired position. Preferably, tube 22 has a calibration number viewing aperture 54 therethrough. Also preferably, shear pin 58 has a pin retaining clip 66.

Figure 2:
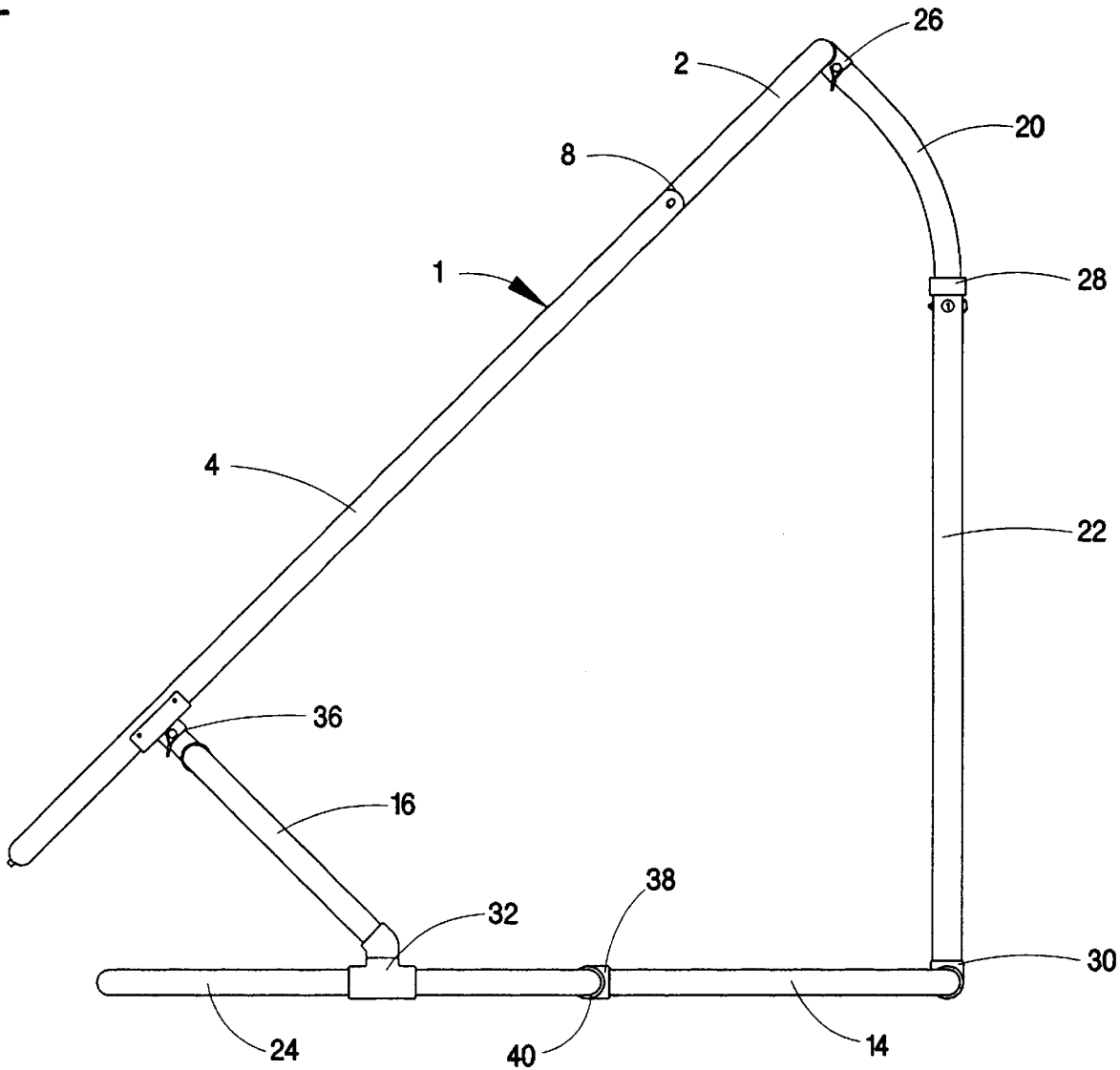
FIG. 2 is a side view of the apparatus depicted in FIG. 1.
Figure 4:
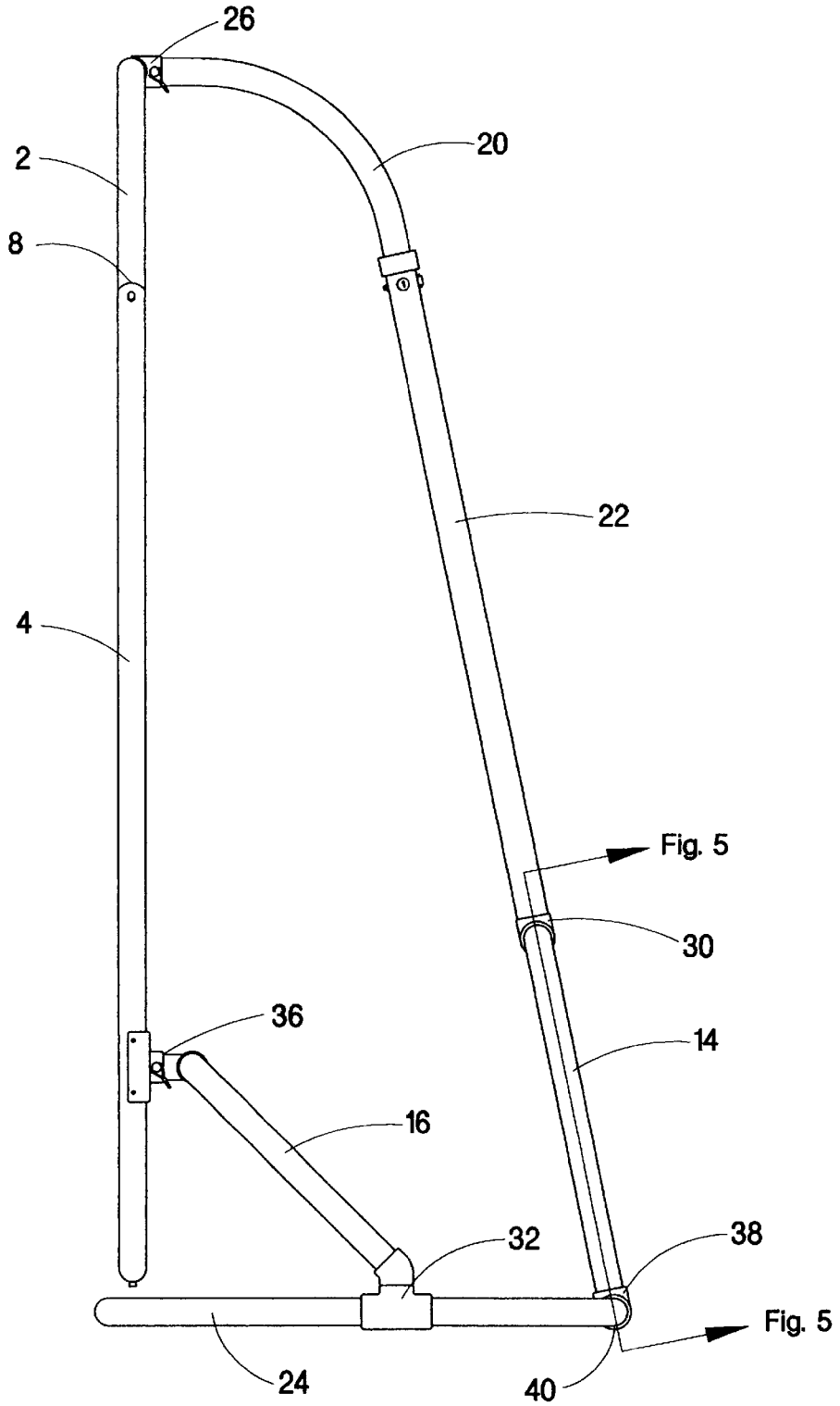
FIG. 4 is a side view of the apparatus depicted in FIG. 1, the view showing the rearward section of its base pivotally upwardly positioned.
Figure 5:
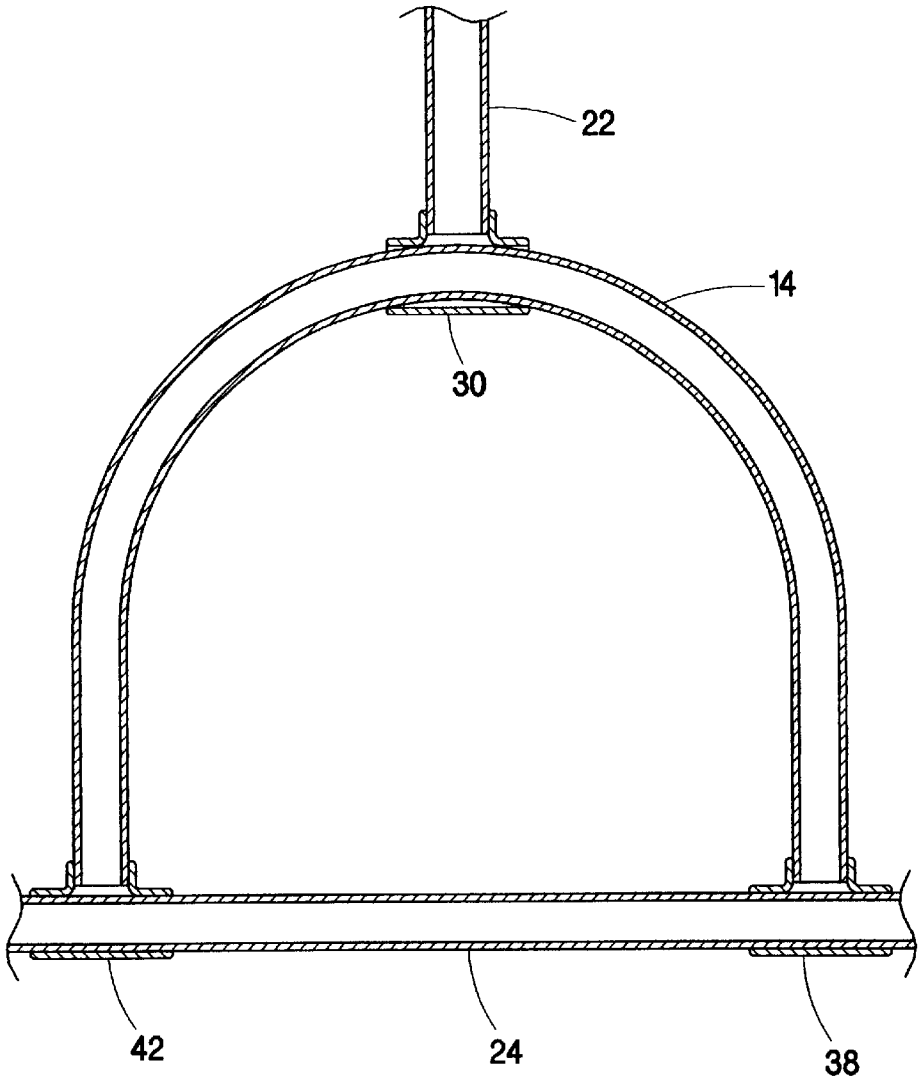
FIG. 5 is a sectional view as indicated in FIG. 4.

Various motions of the golf swing training apparatus are described in FIGS. 2, 3, and 4. In FIG. 2, the apparatus is depicted in its first calibrated position, tube 20 being fully retracted into tube 22 resulting in rotation of the ring 1 about the hinge shafts 16 and 18 to an approximate 45 degree orientation. FIG. 3 shows the apparatus having tube 20 fully extended to its ninth calibrated position, rotating the ring 1 about hinge shafts 16 and 18 to a near vertical orientation. FIG. 4 shows the apparatus having tube 20 fully retracted within tube 22, and showing tube 24 pivoted upwardly. Upon configuring the apparatus as depicted in FIG. 4, the lateral profile of the apparatus is reduced allowing for convenient storage and allowing for movement through narrow doorways.

In operation of the present inventive golf swing training apparatus, referring to FIG. 1, a golfer seeking to utilize the apparatus for swing training necessarily adjusts the angle of the ring 1. Referring simultaneously to FIGS. 1, 3, 6, and 7, the proper adjustment of the angle of the ring 1 with respect to the ground depends upon variables which include the golfer's height, the golfer's arm length, the golfer's club selection, and the golfer's club length. Angular adjustments are achieved through selective extension and retraction of tube 20 within tube 22, such extension and retraction being alternately permitted and resisted through manipulation of the shear pin 58; the shear pin being extendable through any of the shear pin apertures of the tube 22 and through any one of the underlying apertures 62 of tube 20. Upon such adjustment, the golfer, standing inside the ring 1 and holding a club in hand, allows the shaft of the club to slide along the forward face of the ring 1 during the back swing, the down stroke, and the follow through portions of the golfer's swing. Assuming that the golfer is correctly positioned within the ring, and assuming that the ring is adjusted to have a proper angle with respect to the ground, the ring 1 guides the swing through a proper arc within a single plane. By executing several repetitions of such swing and follow through action, a golfer may "groove" his or her swing, improving performance on the golf course.

Referring simultaneously to FIGS. 1 and 3, the ring 1 is easily attached to and removed from the base through manipulation of the shear pins of slip joints 48, 36, and 26.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A golf swing training apparatus comprising:

(a) a base;

(b) a club guide ring;

(c) left, right, and rear hinge shafts, each having left and right ends;

(d) left, right, and rear hinge sleeves, each having a left and a right end, the left, right, and rear hinge shafts respectively extending through the left, right, and rear hinge sleeves so that the left and right ends of said shafts respectively extend leftwardly and rightwardly from the left and right ends of said sleeves, each of said shafts being fixedly attached at its left and right ends to the base or comprising a part of the base; and, (e) respective left, right, and rear means for attaching the club guide ring to the left, right, and rear hinge sleeves; the rear means for attaching the club guide ring to the rear hinge sleeve comprising an alternately extendable and retractable shaft for, upon alternate extension and retraction, alternately pivoting and counter-pivoting the club guide ring about the left and right hinge shafts.

2. The golf swing training apparatus of claim 1 wherein the leftward and rightward extensions of the left and right hinge shafts are arcuate.

3. The golf swing training apparatus of claim 2 wherein the leftward and rightward extensions of the rear hinge shaft are arcuate.

4. The golf swing training apparatus of claim 3 wherein the alternately extendable and retractable shaft comprises an outer sleeve, an inner sleeve telescopingly mounted within the outer sleeve, and means for alternately permitting and resisting telescoping motion of said sleeves.

5. The golf swing training apparatus of claim 4 wherein the means for alternately permitting and resisting telescoping motion comprises a first plurality of shear pin apertures extending through the inner and outer sleeves, and further comprises a first shear pin fitted for alternate slidable insertion into and retraction from selected apertures among the first plurality of shear pin apertures.

6. The golf swing training apparatus of claim 5 wherein the respective left, right, and rear means for attaching the club guide ring to the left, right, and rear hinge sleeves respectively comprise left, right, and rear slip joints.

7. The golf swing training apparatus of claim 6 wherein the left, right, and rear slip joints respectively comprise second, third, and fourth pluralities of shear pin apertures, and second, third, and fourth shear pins, said shear pins being respectively fitted for alternate slidable insertion into and retraction from said shear pin apertures.

8. The golf swing training apparatus of claim 2 wherein the base comprises a forward section and a rearward section, the left and right ends of the left and right hinge shafts being fixedly attached to and positioned upon the forward section of the base; the rearward section of the base being pivotally attached to the forward section of the base so that the rearward section of the base may pivot from a first position wherein the rearward section of the base extends rearwardly, to a second position wherein the rearward section of the base extends upwardly, pivotal motion between said first and second positions pivoting the club guide ring about the left and right hinge shafts.

9. The golf swing training apparatus of claim 8 wherein the leftward and rightward extensions of the left and right hinge shafts are arcuate.

10. The golf swing training apparatus of claim 9 wherein the leftward and rightward extensions of the rear hinge shaft are acuate.

11. The golf swing training apparatus of claim 10 wherein the alternately extendable and retractable shaft comprises an outer sleeve, an inner sleeve telescopingly mounted within the outer sleeve, and means for alternately permitting and resisting telescoping motion of said sleeves.

12. The golf swing training apparatus of claim 11 wherein the means for alternately permitting and resisting telescoping motion comprises a first plurality of shear pin apertures extending through the inner and outer sleeves, and further comprises a first shear pin fitted for alternate slidable insertion into and retraction from selected apertures among the first plurality of shear pin apertures.

13. The golf swing training apparatus of claim 12 wherein the respective left, right, and rear means for attaching the club guide ring to the left, right, and rear hinge sleeve respectively comprise left, right, and rear slip joints.

14. The golf swing training apparatus of claim 13 wherein the left, right, and rear slip joints respectively comprise second, third, and fourth pluralities of shear pin apertures, and second, third, and fourth shear pins, said shear pins being respectively fitted for alternate slidable insertion into and retraction from said shear pin apertures.

* * * * *